US008786199B2

(12) United States Patent
Yoshida et al.

(10) Patent No.: US 8,786,199 B2
(45) Date of Patent: Jul. 22, 2014

(54) METHOD FOR COMPENSATING AND CHECKING LIGHT AMOUNT OF LIGHT-EMITTING DEVICE

(75) Inventors: Harunobu Yoshida, New Taipei (TW); Tz-Liang Chang, New Taipei (TW); Po-Hsiung Peng, New Taipei (TW)

(73) Assignee: Nisho Image Tech Inc., New Taipei (TW)

( * ) Notice: Subject to any disclaimer, the term of this patent is extended or adjusted under 35 U.S.C. 154(b) by 33 days.

(21) Appl. No.: 13/572,032

(22) Filed: Aug. 10, 2012

(65) Prior Publication Data

US 2013/0328487 A1 Dec. 12, 2013

(30) Foreign Application Priority Data

Jun. 8, 2012 (TW) ..... 101120760 A

(51) Int. Cl.
*H05B 37/02* (2006.01)
*B41J 2/435* (2006.01)

(52) U.S. Cl.
USPC ..... 315/152; 315/307; 347/224

(58) Field of Classification Search
CPC ..... H05B 37/02
USPC ..... 315/152, 153, 155, 294, 297, 307; 347/224, 237, 247, 253
See application file for complete search history.

(56) References Cited

U.S. PATENT DOCUMENTS

| | | | | |
|---|---|---|---|---|
| 6,828,538 | B2 * | 12/2004 | Maeda | 250/205 |
| 7,868,557 | B2 * | 1/2011 | Deurenberg et al. | 315/149 |
| 2008/0203927 | A1 * | 8/2008 | Deurenderg et al. | 315/149 |

* cited by examiner

*Primary Examiner* — Daniel D Chang

(57) ABSTRACT

A method for compensating and checking a light amount is applicable to a light-emitting device including a plurality of light-emitting elements, and the following steps are successively executed on the light-emitting elements: measuring an original light amount output by a light-emitting element within a reference time interval; generating a calibration value corresponding to the light-emitting element according to the measured original light amount and a reference light amount; and adjusting light output of the light-emitting element according to the calibration value, so that the original light amount reaches a target light amount.

7 Claims, 9 Drawing Sheets

METHOD FOR COMPENSATING AND CHECKING LIGHT AMOUNT OF LIGHT-EMITTING DEVICE

CROSS-REFERENCES TO RELATED APPLICATIONS

This non-provisional application claims priority under 35 U.S.C. §119(a) on Patent Application No. 101120760 filed in Taiwan, R.O.C. on 2012 Jun. 8, the entire contents of which are hereby incorporated by reference.

BACKGROUND

1. Technical Field

The disclosure relates to a method for checking a light amount, and more particularly to a method for compensating and checking a light amount of a light-emitting device.

2. Related Art

A photocopier, a printer, a fax machine, and a multifunction printer adopt electro-photography as the core technology for printing documents, that is, a photographic image is produced by changing an electrostatic charge with light with a specific wavelength.

Please refer to FIG. 1, in which a schematic view of a color light-emitting diode (LED) printer 100 is shown. The LED printer 100 includes photoconductive drums (110K, 110M, 110C, and 110Y, generally referred to as 110), printing heads (120K, 120M, 120C, and 120Y, generally referred to as 120) and toner cartridges (130K, 130M, 130C, and 130Y, generally referred to as 130), corresponding to black, magenta, cyan and yellow, respectively. An even layer of charges is produced on the surface of the photoconductive drum 110 through a power distribution mechanism. Before printing, an exposure procedure is required in a scanning procedure, so that image pixels in the document to be printed are converted into bright and dark data of visible light. The printing head 120 has a plurality of LEDs. When the light emitted from the LEDs is projected on the photoconductive drum 110, original potential is maintained in unexposed areas, while charges in exposed areas vary due to the exposure. Due to the potential differences of exposed areas, toner with a positive/negative charge provided in the toner cartridge 130 may be attracted, so as to achieve the printing objective.

FIG. 2 is a view illustrating a relationship between a printing concentration and exposure energy accepted by the photoconductive drum. As shown in FIG. 2, the printing concentration is positively correlated to the exposure energy of the photoconductive drum. When the exposure energy accepted by the photoconductive drum increases, the printing concentration also increases, thereby printing document content with different gray scales.

FIG. 3 is a schematic outside view of the printing head 120 of the LED printer 100. As shown in FIG. 3, the printing head 120 includes a plurality of light-emitting chips 122 arranged along an axis 140. Generally speaking, each light-emitting chip 122 includes thousands of linearly arranged LEDs. When the light-emitting chips 122 are arranged along the axis 140, the LEDs are also arranged along the axis 140, so as to achieve high DPI (Dots Per Inch) printing resolution. For example, to achieve a DPI resolution of 1200×2400, 1200 LEDs must be arranged in every inch.

However, to achieve even concentration of the printed document, the light amount output by each LED in the printing head 120 must be controlled precisely, so as to avoid excessive exposure or inadequate exposure of exposed areas of the corresponding photoconductive drum 110. Since the light-emitting characteristics of the LEDs are different from each other, each light-emitting chip 122 has to be tested and calibrated before being mounted in the printing head 120. Each printing head 120 includes a large number of LEDs and each color LED printer 100 further includes four printing heads 120. Therefore, the approach to achieve efficient test and calibration is a subject to which researchers in the art dedicate themselves.

SUMMARY

In view of the foregoing problems, the disclosure provides a method for compensating and checking a light amount of a light-emitting device, so as to solve the problem in the prior art that it is difficult to efficiently test and calibrate the light output of the light-emitting device due to a large number of light-emitting elements of the light-emitting device.

An embodiment of the disclosure provides a method for compensating and checking a light amount of a light-emitting device, where the light-emitting device includes a plurality of light-emitting elements. The method for compensating and checking a light amount includes the following steps successively executed on the light-emitting elements: measuring an original light amount output by a light-emitting element within a reference time interval; generating a calibration value corresponding to the light-emitting element according to the measured original light amount and a reference light amount; and adjusting a light output of the light-emitting element according to the calibration value, so that the original light amount reaches a target light amount.

According to the method for compensating and checking a light amount of a light-emitting device of the disclosure, the calibration value of an individual light-emitting element can be directly obtained. An implementation possibility of the calibration value is first evaluated; if the calibration value is within a proper implementation range, the light output of the light-emitting element is adjusted based on the calibration value; and it is further confirmed whether the light output meets the expectation. Through the two-stage check, the duration for the test and calibration can be shortened, and the light-emitting device can be efficiently tested and calibrated.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
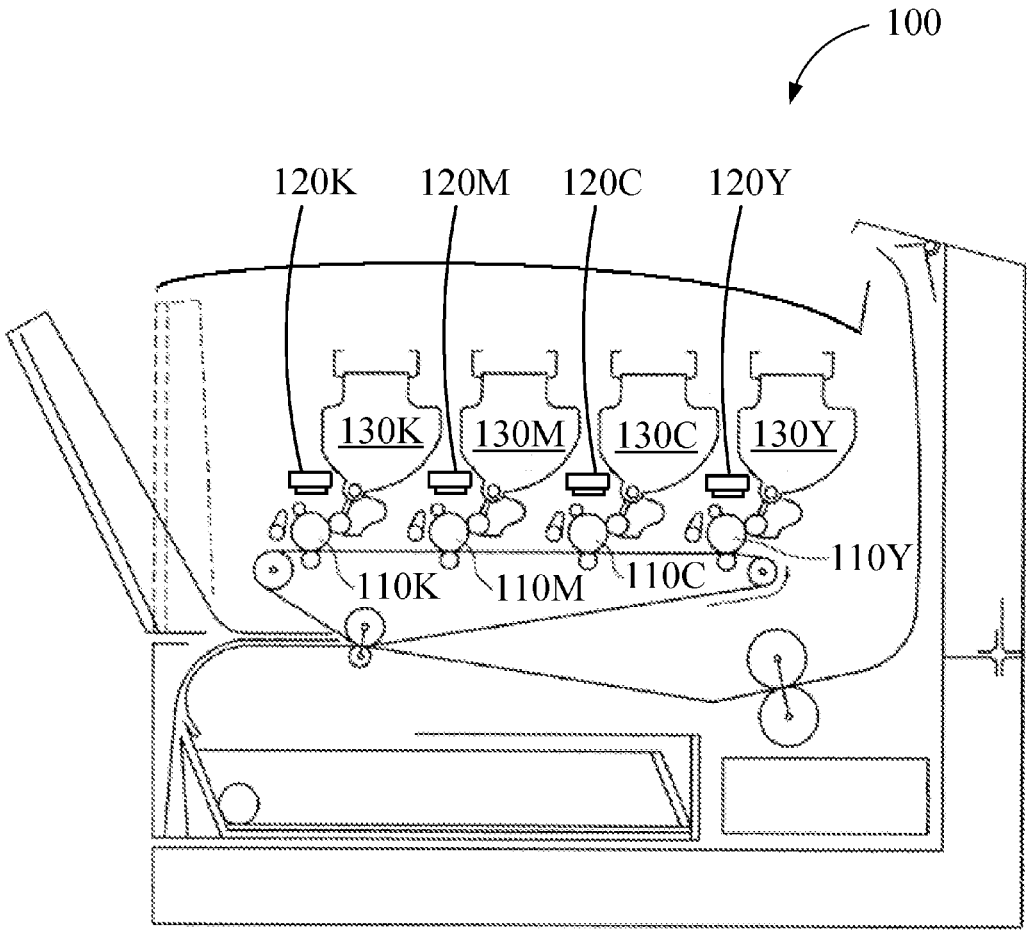
FIG. 1 (Prior art)
FIG. 1 is a schematic view of a color LED printer in the prior art.
Figure 2:
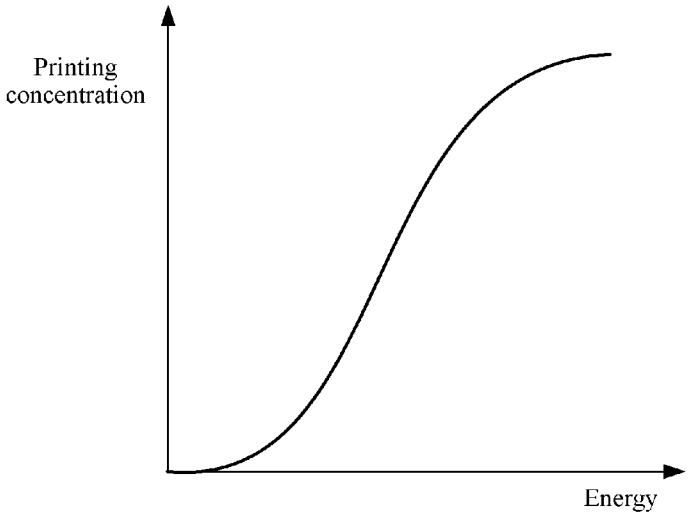
FIG. 2 (Prior art)
FIG. 2 is a view illustrating a relationship between an attracted toner concentration and exposure of a photoconductive drum in the prior art.
Figure 3:
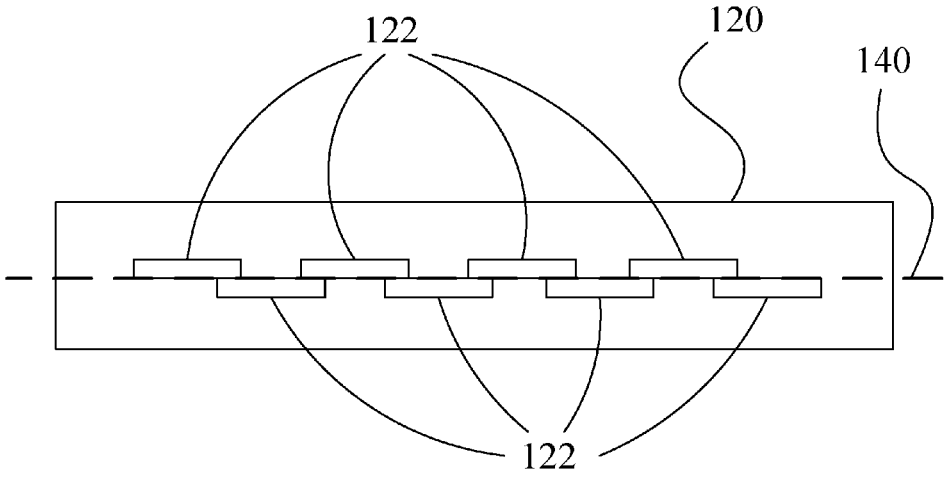
FIG. 3 (Prior art)
FIG. 3 is a schematic outside view of a printing head of the LED printer in the prior art.
Figure 4:
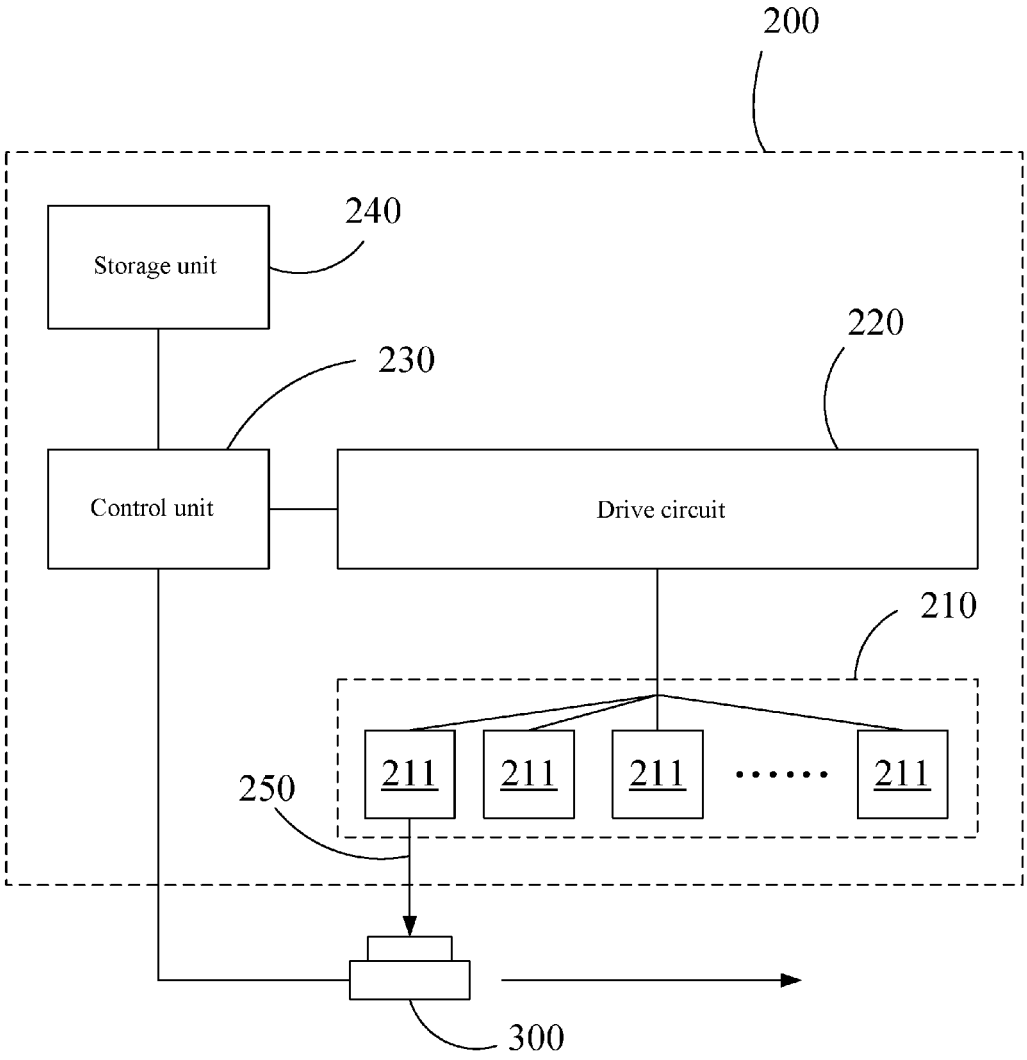
FIG. 4 is a schematic view of a circuit for compensating and checking a light amount of a light-emitting device according to an embodiment.

FIG. 4 is a schematic view of a circuit for compensating and checking a light amount of a light-emitting device 200 according to an embodiment.

As shown in FIG. 4, the light-emitting device 200 includes a light-emitting module 210, a drive circuit 220, and a control unit 230. The light-emitting module 210 includes a plurality of light-emitting elements 211. The drive circuit 220 is used to drive the light-emitting elements 211 to output light. The control unit 230 is coupled to the drive circuit 220, so as to control whether the light-emitting elements 211 output light (being turned on or off), and further control the light amount of output light 250.

In this embodiment, light-emitting elements 211 are light-emitting thyristors and the light-emitting device 200 is a printing head in a printer, but the embodiment is not limited thereto, and the light-emitting elements 211 may also be light output elements such as LEDs and the light-emitting device 200 may also be an exposure member applicable to an imaging device such as a fax machine or a photocopier. Additionally, the light-emitting module 210 may include at least one light-emitting chip 122 having a plurality of linearly arranged light-emitting elements 211.

Figure 5:
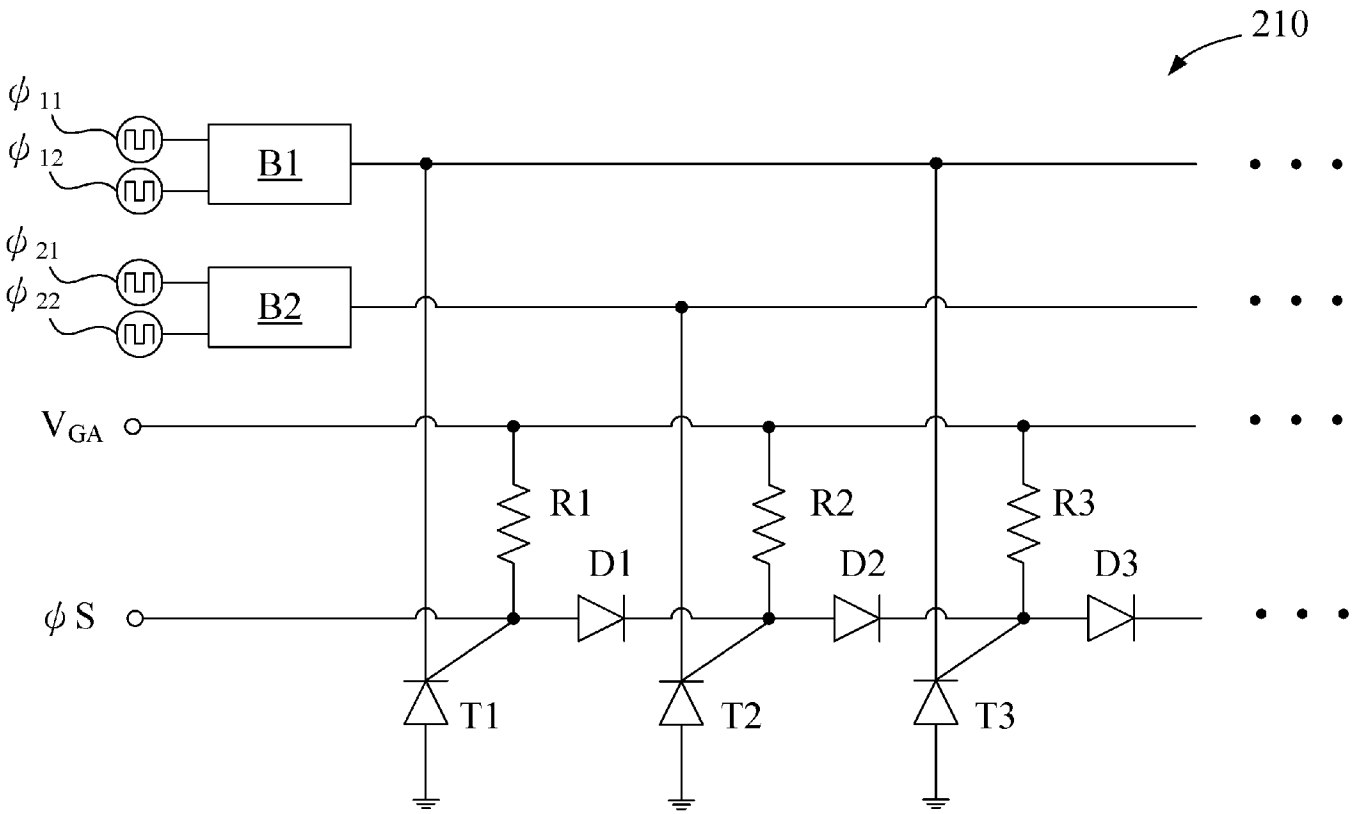
FIG. 5 is a schematic circuit view of a drive circuit according to an embodiment.
Figure 6:
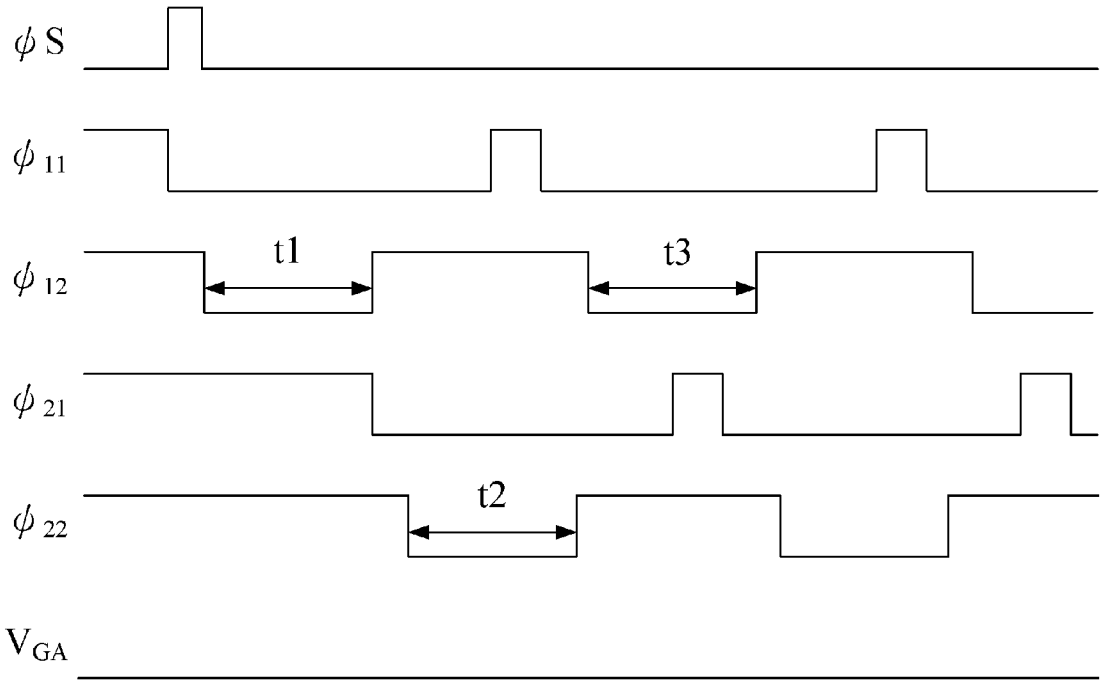
FIG. 6 is a schematic view of a clock signal received by the drive circuit according to an embodiment.

FIG. 5 is a schematic circuit view of the drive circuit 220 according to an embodiment. FIG. 6 is a schematic view of a clock signal received by the drive circuit 220 according to an embodiment.

As shown in FIG. 5, the drive circuit 220 includes light-emitting thyristors (T1, T2, T3 and the like, generally referred to as T), diodes (D1, D2, D3 and the like, generally referred to as D), load resistors (R1, R2, R3 and the like, generally referred to as R), and buffers (B1 and B2).

The light-emitting thyristor T has a gate, a cathode and an anode. When a forward bias occurs between the gate and the cathode, and a voltage difference exceeds a diffusion voltage, the light-emitting thyristor T is turned on. As with a common thyristor, after the light-emitting thyristor T is switched on (turned on), gate potential is nearly the same as anode potential, and when a potential difference between the gate and the cathode returns to 0 volt, the light-emitting thyristor T is turned off (does not emit light).

The gate of each light-emitting thyristor T is coupled to another light-emitting thyristor T through a corresponding diode D (for example, the light-emitting thyristor T1 is coupled to the light-emitting thyristor T2 through the diode D1). The cathode of each light-emitting thyristor T is correspondingly coupled to signals $\phi_{11}$ and $\phi_{12}$, or signals $\phi_{21}$ and $\phi_{22}$ indirectly through a buffer (B1 or B2). For example, the cathode of the light-emitting thyristor T1 is coupled to the signals $\phi_{11}$ and $\phi_{12}$ through the buffer B1; and the cathode of the light-emitting thyristor T2 is coupled to the signals $\phi_{21}$ and $\phi_{22}$ through the buffer B2. A coupled position of the gate of each light-emitting thyristor T and the corresponding diode D is coupled to a voltage $V_{GA}$ through a corresponding load resistor R, respectively (for example, the coupled position of the gate of the light-emitting thyristor T1 and the diode D1 is coupled to a voltage $V_{GA}$ through a load resistor R1).

The gate of the light-emitting thyristor T1 is further coupled to the signal $\phi$S. An anode end of the diode D is coupled to the light-emitting thyristor T adjacent to the signal $\phi$S, and a cathode end of the diode D is coupled to another adjacent light-emitting thyristor T. For example, an anode end of the diode D1 is coupled to the light-emitting thyristor T1 and a cathode end of the diode D1 is coupled to the light-emitting thyristor T2.

The signals $\phi_{11}$, $\phi_{12}$, $\phi_{21}$, $\phi_{22}$, and $\phi$S, and the voltage $V_{GA}$ are provided by the control unit 230, so as to output a clock signal shown in FIG. 6 to control a lighted duration of each light-emitting thyristor T (for example, a lighted duration t1 of the light-emitting thyristor T1, a lighted duration t2 of the light-emitting thyristor T2, and a lighted duration t3 of the light-emitting thyristor T3). That is to say, the control unit 230 may control each light-emitting thyristor T to be turned on for a period of time in sequence through the drive circuit 220.

Here, the drive circuit 220 shown in FIG. 5 is merely exemplary and the embodiment is not limited thereto. All light-emitting elements 211 may be turned on for a period of time in sequence according to a circuit structure of other drive circuits 220 in cooperation with the control unit 230.

Please refer again to FIG. 4, in which a photoelectric conversion unit 300 moves along a direction to measure the light amounts output by the light-emitting elements 211 one by one. Here, the photoelectric conversion unit 300 may be a Charge Coupled Device (CCD), a Complementary Metal-Oxide-Semiconductor (CMOS) or other photoelectric converters. The photoelectric conversion unit 300 is used to receive light emitted by the light-emitting elements 211, and convert the light into an electric signal, so that a voltage or a current of the electric signal correspondingly varies in response to the intensity of the received light.

In some embodiments, the on/off state and the output light amounts of the light-emitting elements 211 can be controlled through the drive circuit 220 and the clock signal output by the control unit 230. Consequently, when a specific light-emitting element 211 is turned on, the photoelectric conversion unit 300 can move to the front of the specific light-emitting element 211 to measure the output light amount thereof. In addition, the photoelectric conversion unit 300 continues to move to the front of a next light-emitting element 211, so as to measure the output light amount when the next light-emitting element 211 is turned on.

In an embodiment, the photoelectric conversion unit 300 is coupled to the control unit 230. The control unit 230 receives the electric signal output by the photoelectric conversion unit 300 and converts the electric signal into intensity of light output by the light-emitting element 211 according to the voltage and the current of the electric signal. Afterwards, the control unit 230 can integrate the light intensity from a first moment to a second moment, so as to obtain the light amount output by the light-emitting elements 211. That is to say, the light amount in the embodiment is an integrated value of the intensity of light output by the light-emitting elements 211 from the first moment to the second moment.

Figure 7:
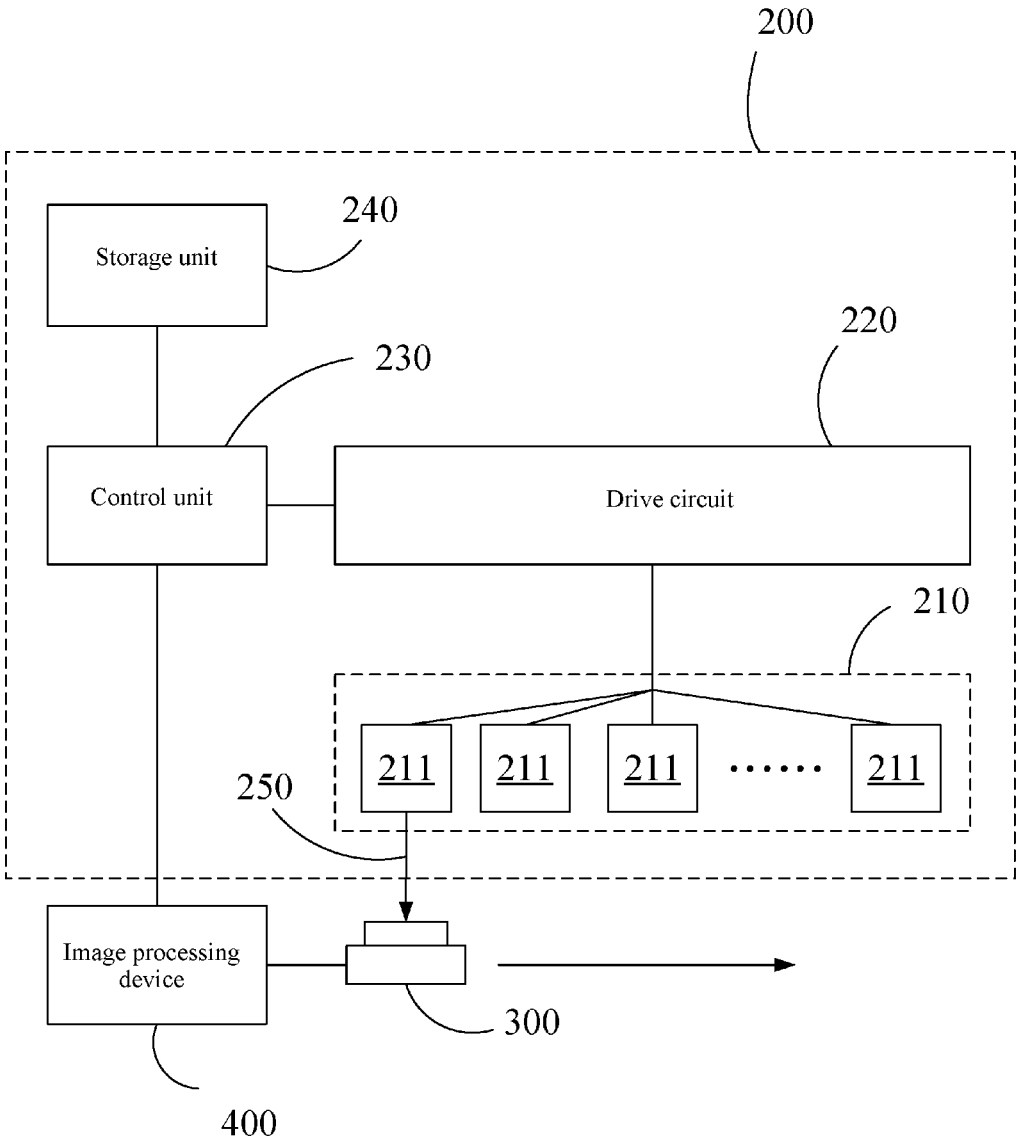
FIG. 7 is a schematic view of another circuit for compensating and checking a light amount of the light-emitting device according to an embodiment.

FIG. 7 is a schematic view of another circuit for compensating and checking a light amount of the light-emitting device 200 according to an embodiment.

Please refer to FIG. 7, in which in an embodiment, the electric signal output by the photoelectric conversion unit 300 is an image signal, and the photoelectric conversion unit 300 is coupled to an image processing device 400 (for example, a programmable logic circuit (FPGA) or a computer). The image processing device 400 analyzes the image signal and then obtains the light amounts of the output light 250 of the light-emitting elements 211. That is to say, according to parameters such as the size and gray scales of bright spots formed due to the light output of the light-emitting elements 211 in the image signal, the image processing device 400 determines the accumulated light amount received from the light-emitting elements 211 by the photoelectric conversion unit 300 from the first moment to the second moment. The image processing device 400 is further coupled to the control unit 230, so as to provide a light amount analysis result to the control unit 230.

Figure 8:
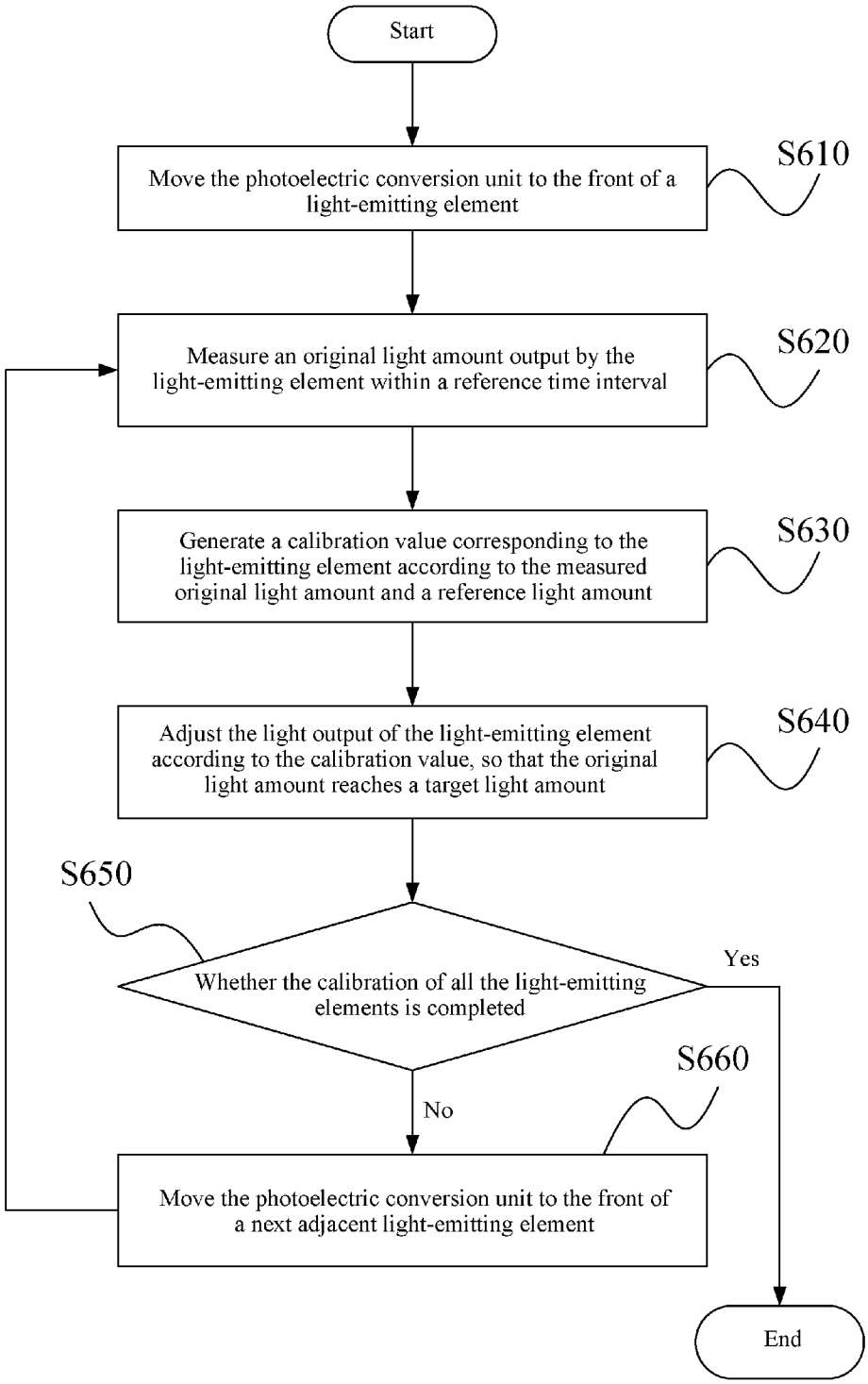
FIG. 8 is a flow chart of compensating and checking a light amount according to an embodiment.

FIG. 8 is a flow chart of compensating and checking a light amount according to an embodiment. The flow shown in FIG. 8 is executed with the circuit for compensating and checking a light amount shown in FIG. 4 and FIG. 7, and the light amounts of the light-emitting elements 211 of the light-emitting device 200 can be measured and calibrated one by one.

Please refer to FIG. 4 and FIG. 8, in which first, after the light-emitting device 200 and the photoelectric conversion unit 300 are initialized, the photoelectric conversion unit 300 is moved to a start end of the linearly arranged light-emitting elements 211 to be located in front of the first light-emitting element 211 (Step S610). Afterwards, an original light amount output by the light-emitting element 211 within a reference time interval (for example, 100 μs), is measured, that is, the drive circuit 220 and the control unit 230 control the light-emitting element 211 to be turned on within the reference time interval, and the control unit 230 or the image processing device 400 converts the light amount into the original light amount output by the light-emitting element 211 according to the electric signal provided by the photoelectric conversion unit 300 (Step S620).

After the original light amount output by the light-emitting element 211 is obtained in Step S620, a calibration value corresponding to the light-emitting element 211 is generated according to the original light amount and a reference light amount (Step S630). The reference light amount is a light amount uniformly output by each light-emitting element 211. Next, Step S640 is executed, that is, a light output of the light-emitting element 211 is adjusted according to the calibration value obtained in Step S620, so that the original light amount reaches the target light amount.

After the calibration of a single light-emitting element 211 is completed from Step S620 to Step S640, the process turns to Step S650, that is, it is determined whether the calibration of all light-emitting elements 211 is completed. If yes, the process is ended; and otherwise, the photoelectric conversion unit 300 is moved to the front of a next adjacent light-emitting element 211. For example, after the calibration of the first light-emitting element 211 is completed, the photoelectric conversion unit 300 is moved to the front of the second light-emitting element 211 (Step S660). After Step S660, the process returns to Step S620, so as to continue to calibrate the next light-emitting element 211.

In some embodiments, before Step S610, the light-emitting element 211 to be measured may be turned on in advance, and other light-emitting elements 211 are turned off, so that during the execution of Step 610, only the light-emitting elements 211 to be measured are turned on.

In some embodiments, the calibration value is a lighted duration of the light-emitting element 211. In Step S640, the control unit 230 may change the reference time interval when the light-emitting element 211 is turned on into the lighted duration (for example, 90 μs), so as to adjust the original light amount into the target light amount. Therefore, the ratio of the reference light amount to the original light amount is substantially equivalent to the ratio of the lighted duration to the reference time interval, according to which the calibration value of the lighted duration can be obtained.

In some embodiments, as shown in FIG. 4, the light-emitting device 200 further includes a storage unit 240. The control unit 230 is coupled to the storage unit 240, so as to store the calibration value in the storage unit 240. Consequently, when the light-emitting device 200 is initialized each time, the calibration value stored in the storage unit 240 is first read. When the light-emitting elements 211 need to be turned on, the light-emitting elements 211 are turned on according to the respective corresponding calibration values, so that the light amount output by each light-emitting element 211 is the same. Therefore, when the light-emitting device 200 using the calibration value to output light exposes a photoconductive element (for example, a photoconductive drum), each illuminated position of the photoconductive element receives the same light amount.

In some embodiments, before Step S603, a comparison table of the reference light amount, the original light amount and the calibration value may be stored in the storage unit 240 in advance. After the original light amount is measured in Step S620, the control unit 230 may read the comparison table in the storage unit 240, and then the calibration value in the comparison table can be obtained according to the reference light amount and the measured original light amount.

In some embodiments, the calibration value corresponds to the brightness of the light-emitting element 211. Specifically, the calibration value may be a drive voltage or a drive current of the light-emitting element 211, and the brightness of the light-emitting element 211 is adjusted by adjusting the drive voltage or the drive current, so that the light amount output by the light-emitting elements 211 varies correspondingly.

Figure 9:
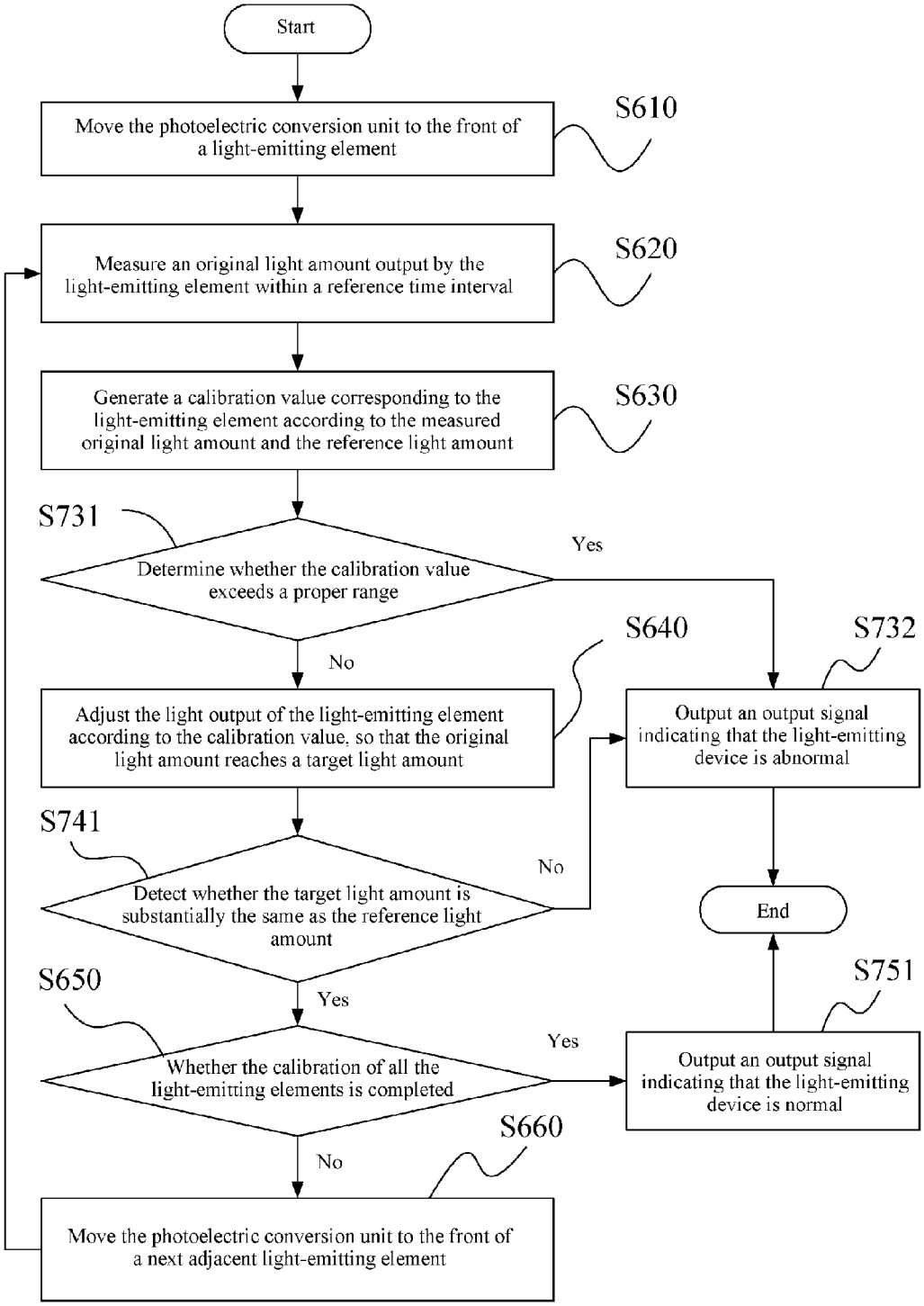
FIG. 9 is another flow chart of compensating and checking a light amount according to an embodiment.

FIG. 9 is another flow chart of compensating and checking a light amount according to an embodiment.

As shown in FIG. 9, before Step S640, Step S731 is further included, that is, it is determined whether the calibration value exceeds a proper range. A calibration range is set according to a demand condition of the light-emitting device 200. If it is found that the calibration value exceeds the calibration range through Step S630, an output signal indicating that the light-emitting device 200 is abnormal is output (Step S732); and otherwise, Step S640 is executed.

After Step S640, Step S741 is further included, that is, it is detected whether the target light amount is substantially the same as the reference light amount. If so, the process turns to Step S650; and otherwise, an output signal indicating that the light-emitting device 200 is normal is output (Step S751).

In Step S650, if the calibration of all the light-emitting elements 211 is completed, the process turns to Step S751, that is, the output signal indicating that the light-emitting device 200 is normal is output.

To sum up, according to the method for compensating and checking a light amount of the light-emitting device 200, the calibration value of an individual light-emitting element is obtained. An implementation possibility of the calibration value is first evaluated; if the calibration value is within a proper implementation range, the light output of the light-emitting element is adjusted based on the calibration value; and it is further confirmed whether the light output meets the expectation. Through the two-stage check, the duration for the test and calibration can be shortened, and the light-emitting device 200 can be efficiently tested and calibrated.

While the disclosure has been described by the way of example and in terms of the preferred embodiments, it is to be understood that the disclosure need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A method for compensating and checking a light amount of a light-emitting device, wherein the light-emitting device comprises a plurality of light-emitting elements, and the method for compensating and checking a light amount comprises:

successively testing each of the light-emitting elements by performing the following steps thereon:

measuring an original light amount output by the light-emitting element within a reference time interval;

generating a calibration value corresponding to the light-emitting element according to the measured original light amount and a reference light amount, wherein the calibration value is a lighted duration of the light-emitting element; and adjusting a light output of the light-emitting element according to the calibration value, so that the original light amount reaches a target light amount.

2. The method for compensating and checking a light amount according to claim 1, wherein after the adjusting the original light amount to a target light amount according to the calibration value, the method comprises:

detecting whether the target light amount is substantially the same as the reference light amount, and outputting an output signal, wherein the output signal indicates that the light-emitting device is normal or abnormal.

3. The method for compensating and checking a light amount according to claim 1, wherein before the adjusting a light output of the light-emitting element according to the calibration value, so that the original light amount reaches a target light amount, the method comprises:

determining whether the calibration value exceeds a proper range, and outputting an output signal, wherein the output signal indicates that the light-emitting device is normal or abnormal; and terminating the testing of the light-emitting elements when the output signal indicates that the light-emitting device is abnormal.

4. The method for compensating and checking a light amount according to claim 1, wherein a ratio of the reference light amount to the original light amount is substantially equivalent to a ratio of the lighted duration to the reference time interval.

5. The method for compensating and checking a light amount according to claim 1, wherein the light-emitting device further comprises a control unit and a storage unit, and before the generating a calibration value corresponding to the light-emitting element according to comparison between a reference light amount and the measured original light amount, the method for compensating and checking a light amount comprises:

storing a comparison table of the reference light amount, the original light amount and the calibration value in the storage unit; and reading the comparison table in the storage unit by the control unit.

6. The method for compensating and checking a light amount according to claim 1, wherein the measuring an original light amount output by the light-emitting element within a reference time interval comprises:

turning on the light-emitting element, and turning off other light-emitting elements.

7. The method for compensating and checking a light amount according to claim 1, further comprising:

providing a photoelectric conversion unit; and successively moving the photoelectric conversion unit to a front of the light-emitting element being tested before the step of measuring the original light amount thereof.

* * * * *